United States Patent [19]

Paine

[11] Patent Number: 4,920,710

[45] Date of Patent: May 1, 1990

[54] RETRACTABLE COLUMN AND METHOD OF FORMING

[76] Inventor: David L. Paine, Rte. 1, Box 192, Ellendale, Minn. 56026

[21] Appl. No.: 343,057

[22] Filed: Apr. 25, 1989

[51] Int. Cl.[5] ..... E04H 12/34

[52] U.S. Cl. ..... 52/108; 52/745

[58] Field of Search ..... 52/108, 632, 745

[56] References Cited

U.S. PATENT DOCUMENTS

| | | | |
|---|---|---|---|
| 2,130,993 | 9/1938 | Dublier | 52/108 |
| 2,661,082 | 12/1953 | Ziegler | 52/108 |
| 2,799,368 | 7/1957 | Alter | 52/108 |
| 3,397,546 | 8/1968 | Eisert et al. . | |
| 4,024,595 | 5/1977 | Brown . | |
| 4,089,147 | 5/1978 | Bain . | |
| 4,237,662 | 12/1980 | Kinzler . | |
| 4,386,485 | 6/1983 | Kramer | 52/108 |

FOREIGN PATENT DOCUMENTS

| | | | |
|---|---|---|---|
| 1361833 | 4/1964 | France | 52/108 |

*Primary Examiner*—John E. Murtagh

*Attorney, Agent, or Firm*—Jacobson & Johnson

[57] ABSTRACT

A retractable support column for overhead structures that comprises there sets of rectangular shaped links that have mating hooks extending laterally outward from adjacent link chains so that the hooks can engage each other when the links are placed vertical next to each other and can disengage each other when the lower link is rotated into a horizontal position with a drive mechanism for engaging gear racks on the link chains to permit the user to raise and lower retractable column.

23 Claims, 6 Drawing Sheets

110
110a
11
90
12
19
19
a
b
c
13
40a
40
40b
10
12a
23
20a
20
15
21a
16
21
22
26
35
25
30
33
27
32

19
120
40
125
126
12
11
132
131
129
130
9
9
40b
40a
19
19
90
110
121
122
13

120
40
121
122a
122
121a
90
110a
90a
110
12
11
136
137
132
131
152
140a
150a
143
153
150
140
138
142
151
141
139

RETRACTABLE COLUMN AND METHOD OF FORMING

FIELD OF THE INVENTION

This invention relates generally to support columns and, more specifically, to retractable support columns for use in supporting overhead structures.

BACKGROUND OF THE INVENTION

The concept of link type structures that can be linked together to form a rigid structure are known in the art. Such structures are generally used for applications such as forming a platform to elevate a person or forming a bridge to permit a user to pass over a water obstacle. Also such structures have been used for docks as well as space applications. In space applications a flexible sheet material is formed into a tower for use in constructing structures in space. In contrast the present invention comprises a retractable column that can be used to suspend heavy overhead structures such as light banks that are used at concerts.

DESCRIPTION OF THE PRIOR ART

The 1953 Ziegler Pat. No. 2,661,082 shows a lightweight retractable structure that includes three separate link like sections that are held together by rivet like projections that have a lip that engages a recess in an adjoining link like section. The Ziegler structure is used to support a lookout platform on top of the structure.

The 1968 Eisert Pat. No. 3,397,546 shows a roll out dock that used a pair of spaced ears to link the sections together to form a light weight dock.

The 1977 Brown Pat. No. 4,024,595 shows a folding linkage bridge having a reinforcement bar extending through the unfolded structure to form a bridge for spanning an obstacle.

The 1978 Bain Pat. No. 4,089,147 shows a collapsible module that uses alternating hinges on adjacent sections to create a structure that is supported by the hinges in a self locking manner.

The 1980 Kinzler Pat. No. 4,237,662 shows an expandable structural support for use in space. The extendable support uses flexible sheet material to form a structural beam for use in space.

SUMMARY OF THE INVENTION

Briefly, the present invention comprises a retractable column formed by three link chains having pivoting hooks extending laterally outward from the side of the link chains. One set of hooks has a C shape and the mating hook has an offset C shape to permit the hooks to pivot into locking engagement with each other when the link chains are raised vertically to form a column. Alignment pins on the struts and link braces with recessed channel permits the link chains to be rolled up into a nesting relationship. The lateral hooks on the link chains form a rigid self supporting triangular shaped column that can be used to support overhead structures. A gear drive mechanism engages a rack gear on two of the link chains to raise or lower the retractable column.

DESCRIPTION OF THE PREFERRED EMBODIMENT

Figure 1:
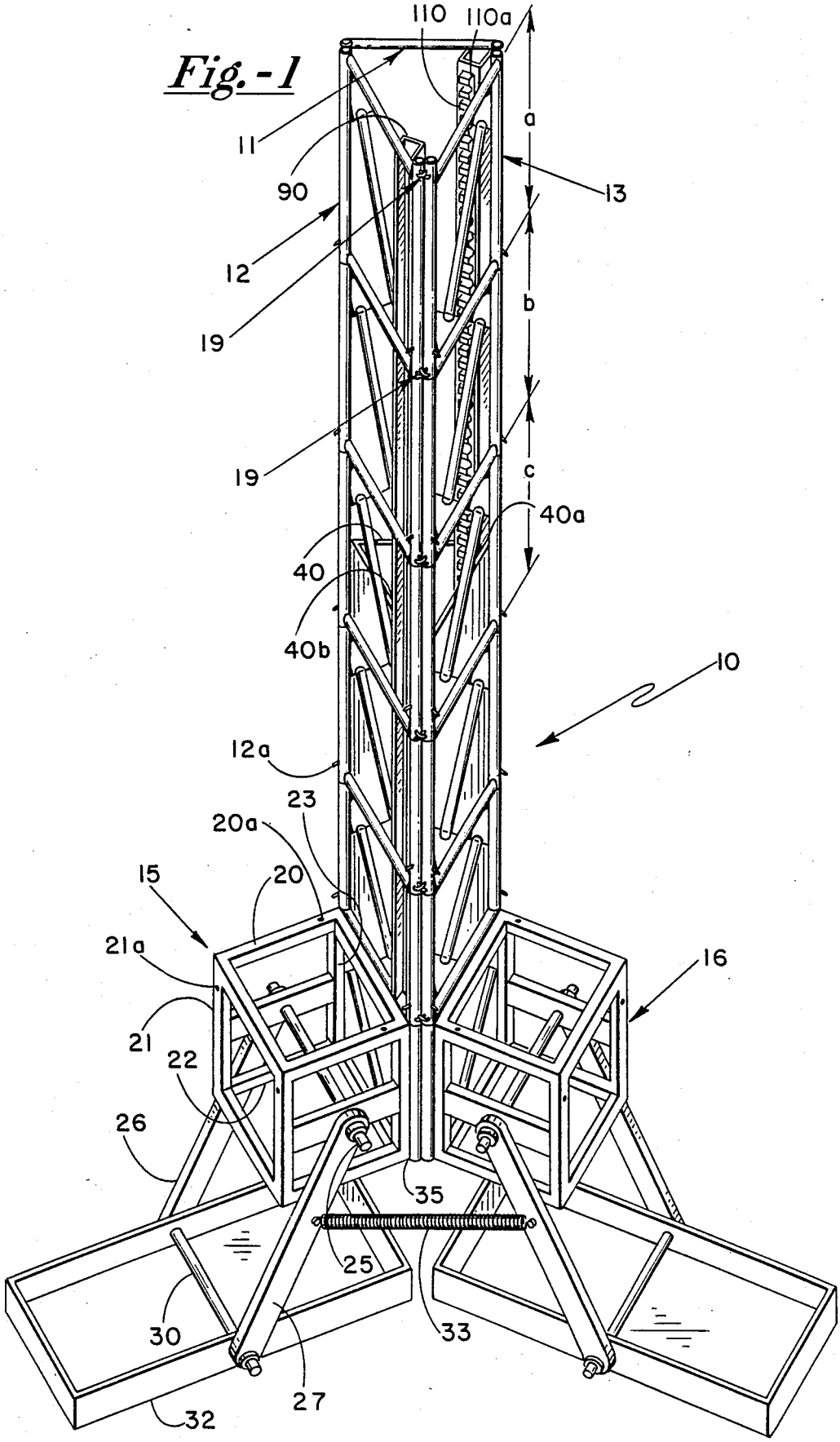
FIG. 1 is a perspective view showing my retractable column in the elevated position.

Referring to FIG. 1 reference numeral 10 identifies my retractable column in the rigid extended condition comprising three separate pivotable link chains 11, 12, and 13 that are held together by hook pairs 19. Except for a gear rack on link chains 11 and 12 each of the link chains 11, 12 and 13 are identical in size and shape. Each link chain contains lateral extending hooks that permit adjacent link chains to be readily connected to together to form a rigid triangular shaped column for supporting overhead structures. The lateral hooks are so shaped and positioned so that they can readily be hooked together by rotation of a lower adjacent link from the horizontal position to the vertical position. Similarly, to unhook or decouple the lateral hooks one rotates the lower adjacent link from the vertical to the horizontal position. The pivotal connection of adjacent links permit each of the links that form the retractable column to be rolled up and stored on separate take up mechanisms. The take up mechanism for link chain 12 is identified by reference numeral number 15 and the take up mechanism for link chain 13 is identified by reference numeral 16. Similarly, an identical take up mechanism (not shown) permits the operator to roll and store link chain 11 thereon.

Take up mechanism 15 comprises a square box shaped core that has four face members 20, 21, 22, and 23 that support and store the links of the link chain 12 in a square shaped roll. Extending through the geometric center of take up mechanism 15 is a pivot rod 25 that is rotatable supported on one end by a pivotable brace 26 and on the opposite end by a pivotable brace 27. Pivotable braces 26 and 27 pivot about a pivot rod 30 that extends through floor support base 32. An inward force is provided to the take up mechanism 15 and 16 through a tension spring 33 that connects pivotable brace 27 to the adjacent take up mechanism 16. An identical tension spring (not shown) connects pivotable brace 26 to the take up mechanism (not shown) located on the opposite side of my retractable column. The coaction of the tension springs between adjacent take up mechanism hold the take up mechanism proximate each other to permit the link chains to be unrolled together. The end of link chain 12 is pivotable connected to take up mechanism 15 through a pivot link 35 and an identical pivot link (not shown) located on the opposite side of take up mechanism 15. Similarly, each of the other link chains have a link pivotally connecting the link chain to the take up mechanism.

In order to compactly store the link chains on the take up mechanism I provide links of increasing length. That is, as viewed in FIG. 1 the links at the top of the column have a length a and the adjacent link has a length b which is slightly shorter than length a. Similarly, the next adjacent link has a length c that is slightly shorter than length b. The purpose of the different size links is to permit the individual links to be wound on to the square take up mechanisms in a layered fashion. That is, as more links are wound on to the take up mechanism the diameter of the take up mechanism increases requiring a longer link to extend across the face of the take up mechanism. In order for the links to positively engage each other and the take up mechanism I utilize a set of link alignment pins 12*a* that engage recesses in the adjoining link or the take up mechanism. FIG. 1 shows alignment pins 12*a* extending perpendicular outward from the struts on link chain 12. Located on face 20 are a set of mating recesses 20*b* and similarly located on face 21 is a set of recesses 21*b* for engaging an alignment pin 12*a* on link chain 12. That is as take up mechanism 15 rolls upward with a link the struts fold along face 20 with the alignment pins 12*a* engaging the recess 20*b* to positively hold the link chain on the take up mechanism. The engagement of the links with the take up mechanism or an adjoining link serves a twofold purpose. First, it positively connects the link chain to the take up mechanism or an adjoining link on the take up mechanism to insure that the link chain rolls on to the take up mechanism. Second, it also prevents lateral displacement of the link chain as the chain is rolled up. The result is that the link chains can be formed into an interlocking engagement on the take up mechanism.

Figure 8:
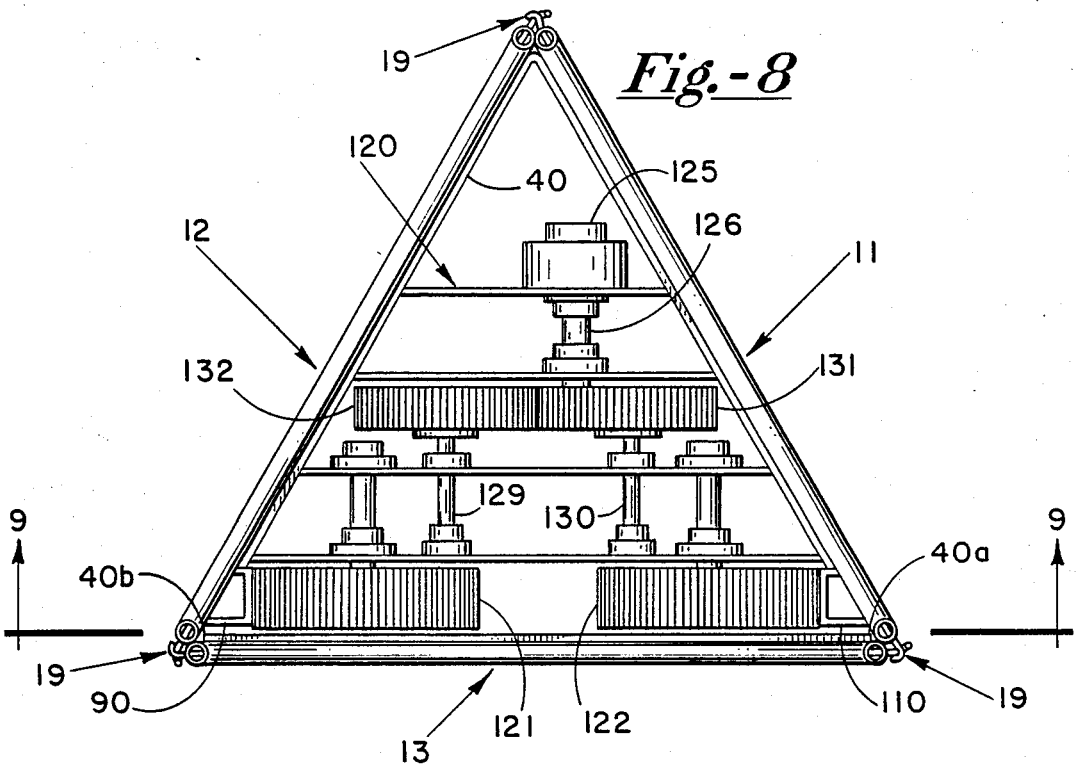
FIG. 8 shows a partial top view of the drive mechanism for raising and lowering my retractable column.
Figure 9:
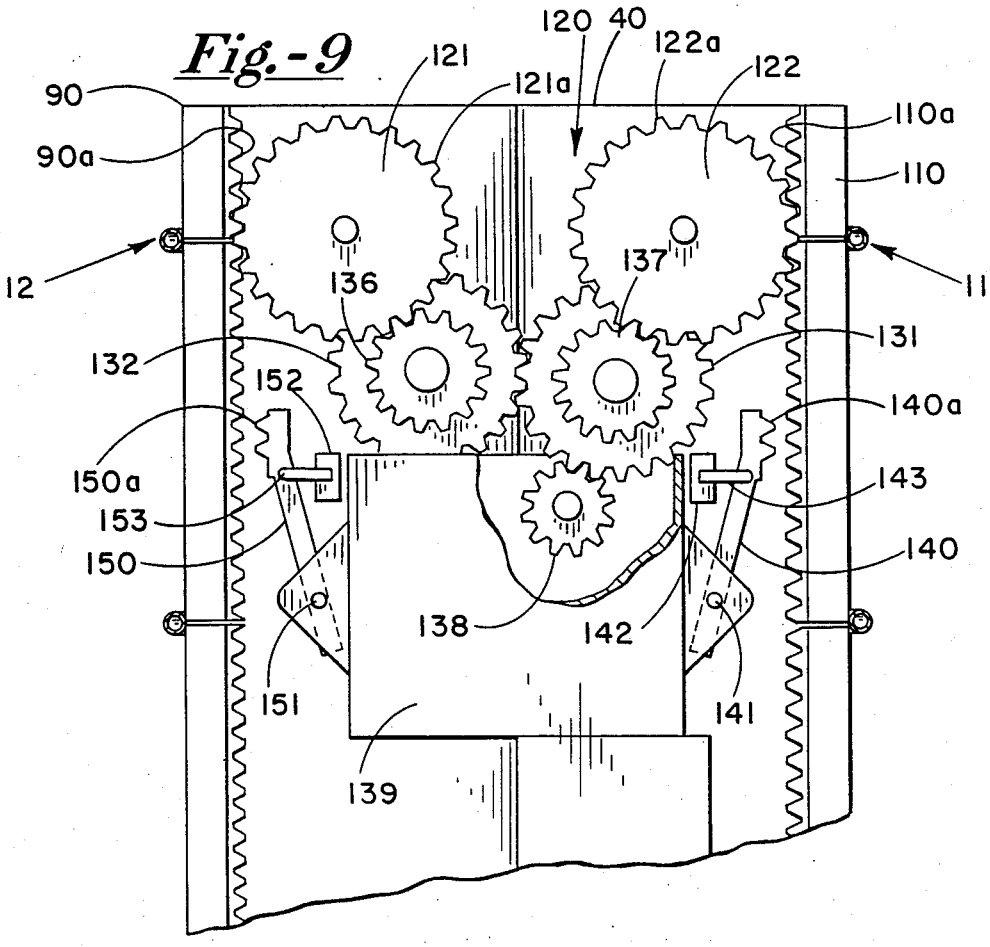
FIG. 9 shows a side sectional view of the drive mechanism for raising and lowering my retractable column.

In operation of my system the individual pivotable links of the link chains are lifted vertically upward through gear racks 90 and 110 and a gear drive mechanism 120 which are shown in greater detail in FIG. 8 and FIG. 9. In order to guide the links into initial columnar alignment I provide a triangular shaped internal column guide 40 that guides the individual links into into a triangular shaped rigid support column. Located on one side of columnar guide 40 is an elongated vertical slot 40*a* for gear rack 110 on link chain 11 to extend into engagement with a drive gear 122 on my drive mechanism 120 and located on the other side is a similar elongated vertical slot 40*b* for gear rack 90 on link chain 12 to extend into a second drive gear 110 on my drive gear mechanism 120.

Figure 2:
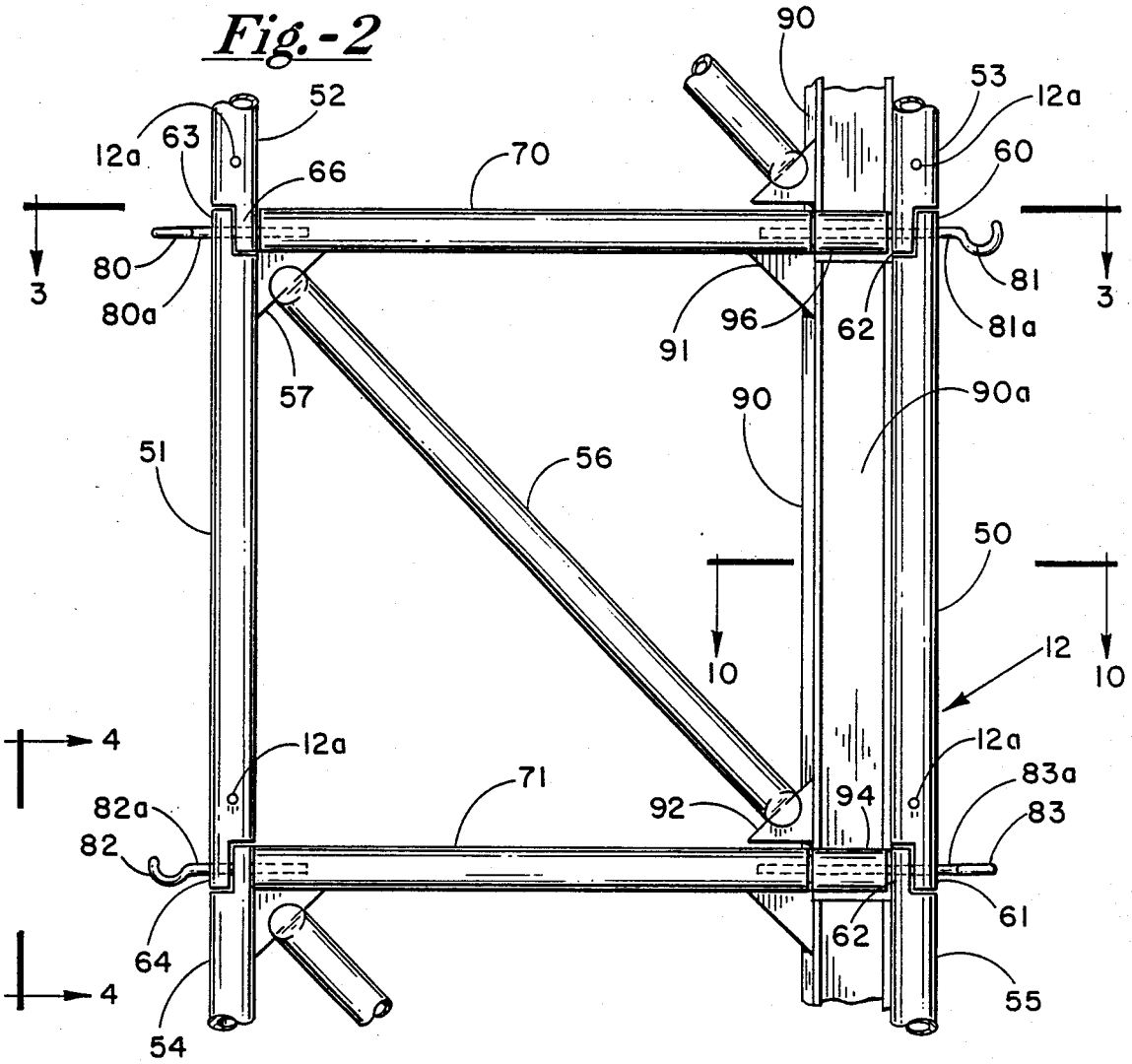
FIG. 2 is a front view of one of the three sets of folding links that connect together to form my retractable column.
Figure 3:
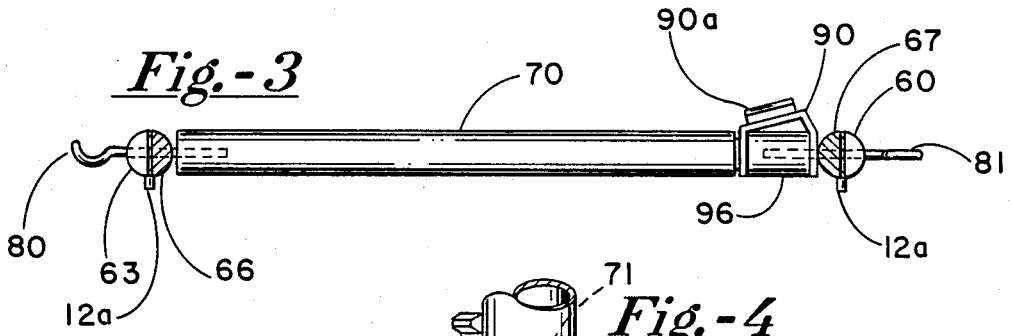
FIG. 3 is a top view taken along line 3—3 of FIG. 2.
Figure 4:
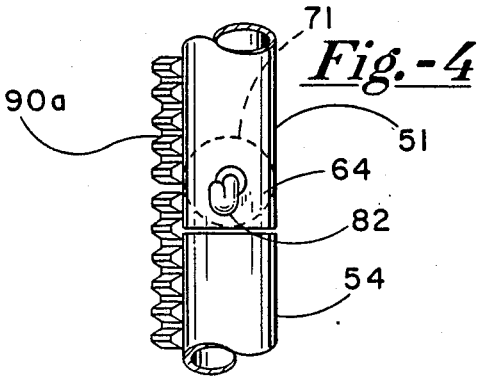
FIG. 4 is a side view taken along line 4—4 of FIG. 2.

In order to understand the pivotable coupling and decoupling of the lateral hooks on my link chains reference should be made to FIGS. 2 to 4 which show a portion of on adjacent link chains 11 and 13 to form my triangular shaped retractable column for supporting overhead structures such as light sets for concert stages.

FIG. 2 shows a front view of a portion of link chain 12. Link chain 12 comprises a set of pivotable connected links that pivot about a central axis extending through spacer 70 and spacer 71. A single rigid link is defined by a strut 51, a spacer 70, a link brace or a gear rack 90 on the back side, a second strut 50 and a cross brace 56. Located on each side of link chain 12 are vertical parallel cylindrical struts 51 and 50 that have the same width throughout the link chain although adjacent links may be of different length. Although each link is a rigid structure it pivots with respect to each adjacent link along a central axis extending through the parallel spaced spacers 70 and 71. To provide the pivoting action around the central axis extending through spacer 71 I provide the lower end of cylindrical strut 51 with a tongue 64 that pivotable connects around a cylindrical rod 82*a* that has a straight section that extends into spacer 71 along the central axis of spacer 71. The other end of cylindrical rod 82*a* is formed into an offset C shaped hook 82 for coupling with a mating hook. Similarly, to provide for pivoting action of upper strut 52 about the central axis of spacer 70 I provide the end of strut 52 with a similar tongue 66 that pivotable connects around a cylindrical shaft 80*a* that has a straight section that extends coaxial with the central axis of spacer 70. Located on one end of cylindrical rod 80*a* is a C shaped hook for forming locking engagement with a hook on an adjacent link chain. The top portion of strut 51 forms non pivoting engagement with cylindrical rod 80*a* and also rigidly connects to spacer 70 through a gusset 57 that is welded to vertical strut 51 and horizontal spacer 70 to thereby hold strut 51 and spacer 71 at right angles to one another and in integral pivotable relationship to the adjacent link in the link chain.

The vertical strut 50 located on the right side of link chain 12 includes an upper tongue 60 that extends in nonpivotable engagement around a cylindrical rod 81*a* that has a straight section located coaxial with the central axis of spacer 70. The other end of cylindrical rod 81*a* has an offset C shaped hook 81 that forms mating engagement with the C shaped hook on an adjacent link chain. To provide the pivotable relationship between the right side portion of adjacent links in the link chain the upper strut 53 contains a tongue 62 that forms pivotable engagement with rod 81*a*. Similarly a link brace gear rack 90 includes a cylindrical collar 96 that forms pivotable engagement with cylindrical rod 81*a* which extends coaxially into spacer 70. The pivotal connections of link brace gear rack 90 and strut 52 permit the upper link to pivot along an axis extending centrally through spacer 70.

The lower end of strut 50 includes a tongue 61 that forms pivotable engagement with a cylindrical shaft 83*a* that has a straight end located coaxially with the central axis of spacer 71. The other end of shaft 83*a* has a C shaped hook for engaging a hook on an adjacent link chain. Located parallel to strut 50 is vertical link brace and gear rack 90 that has the top end welded to one side of a triangular shaped corner gusset 91 with the other side of gusset 91 welded to spacer 70. The combination of gusset 91 and spacer 70 coact with gusset 57 and vertical strut 51 to form a rigid section of link chain 12 through the use of cross brace 56 that fixedly extends from corner gusset 57 to side gusset 92 on link brace gear rack 90. The lower end of link brace gear rack 90 includes a cylindrical housing 94 that forms pivotable engagement with the straight end of shaft 83*a* that extends into spacer 71 to form a link pivoting connection along the central axis of spacer 71.

The lower link of link chain 12 includes a vertical strut 55 that is virtually identical to strut 50. Strut 55 forms nonpivotable engagement around the straight end of shaft 83*a*. The adjacent vertical link brace gear rack is identical to vertical link brace gear rack 90. The combination of virtually identical struts and braces enables the lower link to pivot with respect to the adjacent link along an axis extending centrally though spacer 71. Similarly, the strut 53, vertical link brace gear rack 90 and strut 51 permit the upper link to pivot about a central axis extending through cylindrical spacer 70 thereby providing a link chain of individually pivotable links that are pivotable along the central axis of each of the parallel spaced spacers in the link chain.

The lateral C shaped hook 80 and offset C shaped hook 81 that extend laterally outward from the side of link chain 12 are fixedly connected to strut 51, spacer 70 and strut 50 so that the rotation of strut 51 and strut 50 causes the links 80 and 81 to also rotate about the central axis extending through spacer 70. Similarly, the lower offset C shaped hook 82 and C shaped hook 83 are fixedly connected to strut 54, spacer 71 and strut 55 so that rotation of the lower link produces a corresponding rotation of hooks 82 and 83 about the central axis extending through spacer 71.

In order to appreciate the offset C shaped arrangement of hooks 81 and 82 I have shown a side view in FIG. 4 that reveals the vertical strut 51 and the vertical strut 54 with the offset C shaped hook 82 extending outward in an offset relationship to the vertical struts. In the present arrangement of link chains offset hooks extend outward at an angle of approximately 30 degrees to the vertical.

The top view shown in FIG. 3 shows C shaped hook 80 to comprise a semi circular or C shaped member that has one end extending coaxially into one end of spacer 70. Located on the other end of spacer 70 is an offset C shaped hook 81 also having one end extending coaxially into the other end of spacer 70. FIG. 3 also shows link brace gear rack 90 with gear teeth 90*a* for engaging a drive gear of my gear drive mechanism 120.

Figure 5:
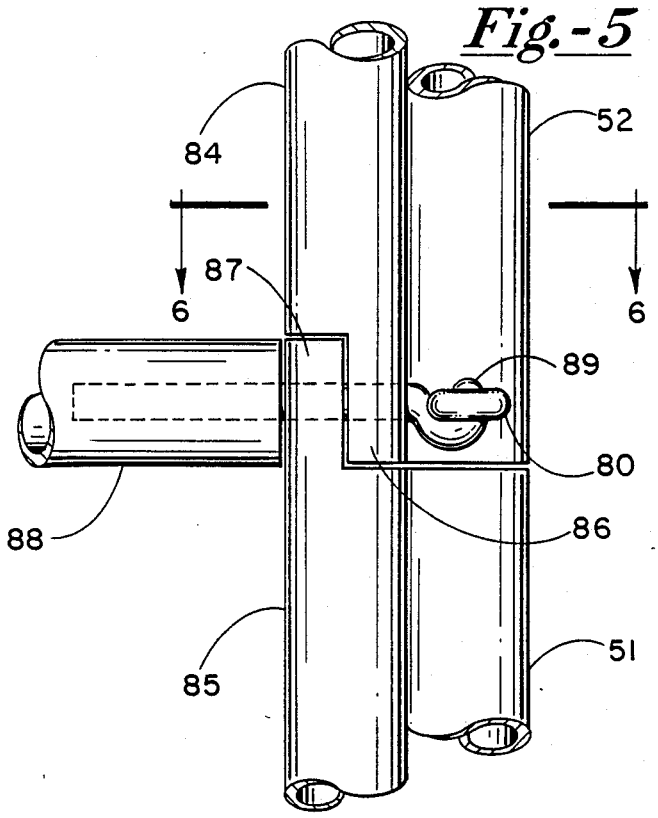
FIG. 5 is a partial side view showing the adjacent link sections hooked together.

FIG. 5 shows a detail of the interlocking arrangement formed between an adjacent C shaped hook and an offset C shaped hook on adjacent link chains. Vertical strut 84 and 85 are identified with an offset C shaped hook 89 having one end extending upward and through the opening in the C shaped hook 80. Vertical struts 52 and 51 represent struts from an adjacent link chain.

Figure 6:
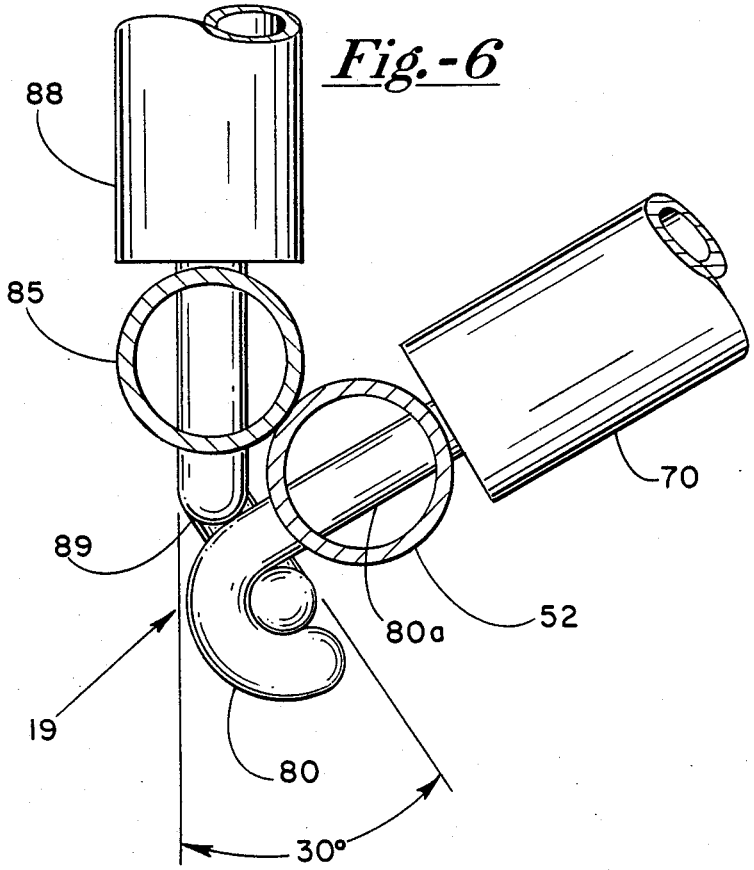
FIG. 6 is a top partial sectional view taken along line 6—6 showing adjacent links in locked interconnecting relationship.

FIG. 6 shows a partial top sectional view taken along line 6—6 of FIG. 5 and reveals the interlocking engagement formed between offset C shaped hook 89 and the C shaped hook 80. It is the interlocking engagement formed between lateral hook 89 and lateral hook 80 that provides the lateral connection to hold adjacent link chains in position next to each other. That is the adjacent struts 85 and 52 contact each other to prevent inward collapsing of the link chains while the hooks 89 and 80 prevent the link chains from collapsing outward. When multiple lateral hooks are connected to vertical struts use one can hold the adjacent link chains in a triangular shaped column as shown in FIG. 1.

Figure 7:
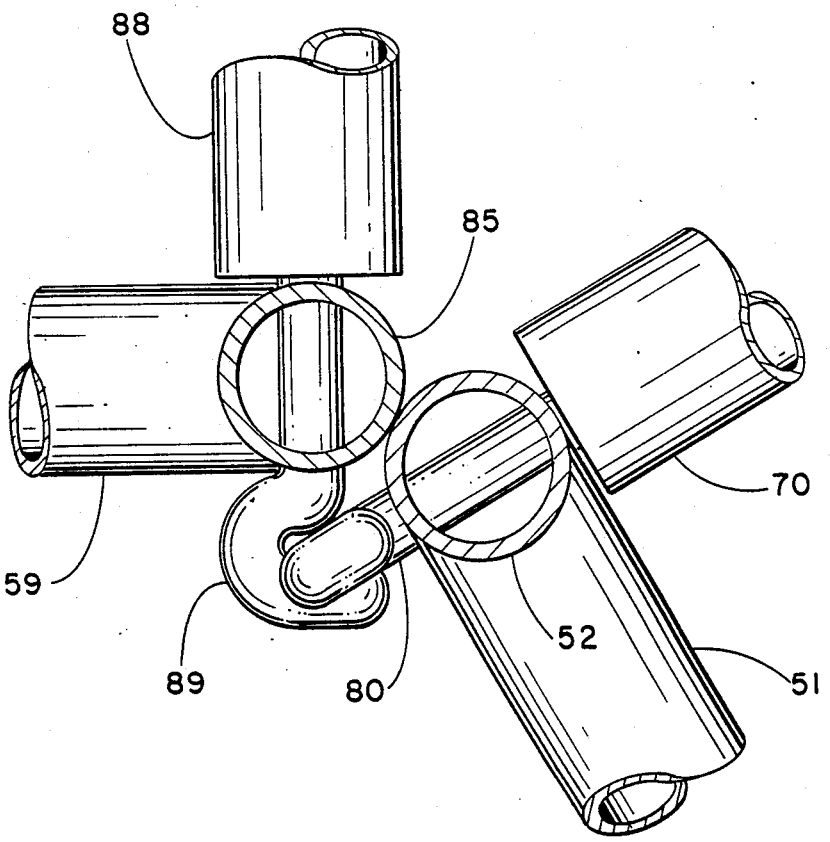
FIG. 7 shows the position of the interconnecting links on adjacent link chains with the position of the hooks during the coupling or decoupling of the link chains.

While FIG. 6 shows the C shaped hook 80 and the offset C shaped hook 89 in locking engagement FIG. 7 shows the offset C shaped hook as they are rotated into locking engagement. That is, the struts on the lower link have rotated C shaped hook 80 about its central axis and offset C shaped hook 89 about its central axis. As can be seen from FIG. 6 and FIG. 7 the use of one offset C shaped hook and a C shaped hook permit the operate to rotate the struts 51 and 59 on the lower links and thereby rotate hooks 89 and 80 until they are coupled into interlocking engagement when the struts 51 and 59 are located vertically. Likewise rotating the lower link about its central axis in the opposite direction also decouples the hooks from interconnecting engagement. Thus my invention permits the user to couple the links on the link chains into interlocking engagement through pivotal rotation of the link chains from the horizontal to the vertical position. Similarly, one can decouple the hooks on the link chains by rotating the lowermost links from the vertical position to the horizontal position. FIG. 6 shows that offset C shaped hook 89 is offset at an angle of approximatly 30 degrees for a vertical plane. Although both hooks have a C shape for engaging with one another the offsetting of one of the hooks in a hook pair 19 permits one to couple or decouple the hooks from one another solely through the pivotal rotation of the hooks with the links of the link chain. The arrangement of C shaped hooks in alternating relationship with offset C shaped hooks permits the link chains to be coupled to lateral hooks on adjacent links to form the link chains into a triangular shaped retractable column.

Figure 10:
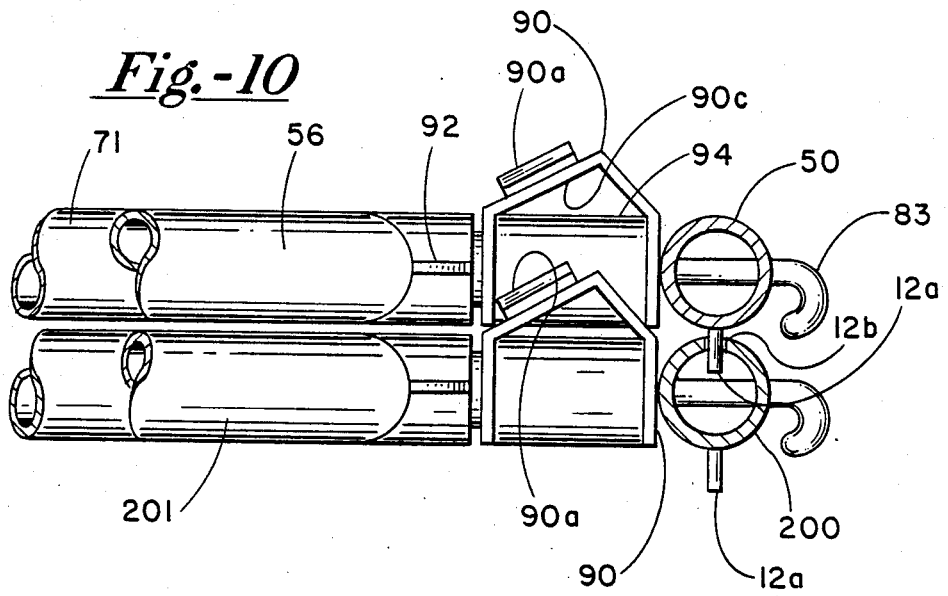
FIG. 10 shows a partial sectional view of link struts stacked next to each other in a nesting relationship.

One of the features of my invention is the nesting relationship of the adjacent links on a take up mechanism. To illustrate the nesting relation ship of adjacent links reference should be made to FIG. 10 which shows a sectioned portion of a second link in nesting relationship to a second sectioned link. Reference numeral 50 identifies the link strut and reference numeral 90 identifies the link brace which has a front channel recess 90*c* that permits the protruding gear teeth 90*a* on an adjacent stacked link having a strut 200 and a spacer 201 to fit into the channel recess 90*c* on the adjacent stacked link. In addition to the nesting relationship of the links shown in FIG. 10, it also shows the interlocking relationship of the struts that are located on the take up mechanism. That is, the pin 12*a* on strut 50 is shown fitting into the recess 12*b* on strut 200 to thereby prevent any lateral movement of either of the struts with respect to one another.

Referring to FIG. 8 and FIG. 9, FIG. 8 shows a top view of drive mechanism 120 that raises and lowers the link chains forming my retractable column while FIG. 9 shows a side view of the drive mechanism 120. Drive mechanism 120 is located within the confines of triangular columnar guide 40 with a drive gear 121 located adjacent vertical elongated slot 40*b* and a drive gear 122 located adjacent vertical elongated slot 40*a*. Drive mechanism 105 comprises an electric motor 125 that drives rack lift gears 121 and 122 through a gear reduction mechanism of approximately 8 to 1. The drive mechanism includes a motor drive gear 138 that rotates gear 131 and a smaller reduction gear 137 connected to gear 131 through a drive shaft 130. Gear 131 drives gear 122 so that gear teeth 122*a* engage rack teeth 110*a* located on the back side of link brace 110. Gear 131 also drives gear 132 and a smaller reduction gear 136 which is connected to gear 132 through a drive shaft 129. Gear 136 drives gear 121 and gear rack 121 which includes teeth 121*a* that engage the rack teeth 90*a* on the back side of link brace gear rack 90.

FIG. 8 and FIG. 9 show link brace gear rack 90 and gear rack teeth 90*a* extending through the elongated slot 40*b* and into the triangular shaped guide column 40 to contact the gear teeth 121*a* on lift gear 121. Similarly, link brace gear rack 110 and gear rack teeth 110*a* extend through the elongated slot 40*a* and into the triangular shape guide column 40 to contact the gear teeth 122*a* on lift gear 122.

The combination of a drive reduction mechanism with a drive motor such as an electric motor allows the user to lift the links of the link chain upward even tho there may be a load on top of the retractable column. My retractable column can be used in different applications and for lifting and supporting overhead structures in excess of 20,000 pounds.

In the event of power failure while raising or lowering my retractable column I provide for solenoid activated dogs 140 and 150 that engage the corresponding gear racks on the back of the link braces. FIG. 9 shows a pivotable dog 140 that pivots about pivot pin 141. The top end of dog 140 contains teeth 140*a* that are normally spaced from gear rack teeth 110*a*. If power should be cut off to the system a solenoid 142 release dog 140 to rotate clockwise and into interlocking engagement with teeth 110*a* thereby stopping the downward motion of the retractable column. Similarly, a pivotal dog 150 is located in a normally spaced relationship to gear rack teeth 90*a*. Dog 150 pivots about a pivot pin 151. If power should be cut off to the system a solenoid 152 releases dog 150 to permit dog 150 to pivot counterclockwise so that dog teeth 150*a* engage rack teeth 90*a* and stop any further down ward motion of my retractable column.

I claim:

1. A retractable column for supporting an overhead structure comprising:

a first link chain, said first link chain having pivotable links, said pivotable links including a plurality of C shaped hooks extending laterally outward from said first link chain;and a second link chain, said second link chain having pivotable links with a plurality of offset C shaped hooks for forming interlocking engagement with said plurality of C shaped hook on said first link chain to thereby couple said first link chain and said second link chain into a rigid support column.

2. The retractable column of claim 1 including at least three link chains each forming locking engagement with an adjacent link chain.

3. The retractable column of claim 2 including take up mechanism for storing said link chains in a rolled condition.

4. The retractable column of claim 3 wherein said first link chains includes a first strut having said C shaped hook extending laterally from said first strut and said second link chain includes a second strut having said offset C shaped hook extending laterally from said second strut so that said C shaped hook and said offset C shaped hook form interlocking engagement with each other to hold said first strut and said second strut in parallel contacting relationship with each other.

5. The retractable column of claim 4 including a column guide located interior to a column formed by said link chains.

6. The retractable claim of claim 5 wherein each of said link chains includes a first strut and a second strut with a first spacer extending perpendicularly between said first strut and said second strut on each of said link chains.

7. The retractable column of claim 6 wherein each of said link chains includes a link brace to permit said first strut, said second strut and said spacer to form a rigid link.

8. The retractable column of claim 7 wherein each of said first strut and said second strut on said link chains includes a lower section for forming pivotable engagement with an adjoining link.

9. The retractable column of claim 8 wherein said C shaped hook comprises a cylindrical rod having a straight shank axially aligned with the central pivot axis of a spacer to form an axial pivot line for said C shaped hook.

10. The retractable column of claim 9 wherein said offset C shaped hook includes a cylindrical rod having a straight shank axially aligned with a second spacer to form an axial pivot line for said offset C shaped hook.

11. The retractable column of claim 10 including a lift mechanism comprising a gear rack connected to said first link chain and a gear drive mechanism for engaging said gear rack to raise and lower said retractable column.

12. The retractable column of claim 11 including a pivotable dog for automatically engaging said gear rack in the event of power failure to prevent said retractable column from collapsing.

13. A retractable column for storing in a rolled condition and for unrolling to form a rigid vertical column to support an overhead structure comprising:

a first link chain, said first link chain including a plurality of pivotable links, each of said pivotable links including a pair of cylindrical struts with spacers extending between said struts to hold said struts on said first link chain in a parallel spaced relationship, each of said cylindrical struts including a hook extending laterally outward from said strut for engaging with a hook on an adjacent link chain;and a second link chain, said second link chain including a plurality of pivotable links, each of said pivotable links including a pair of cylindrical struts with spacers extending between said struts to hold said struts in a parallel spaced relationship, each of said cylindrical struts including a hook extending laterally outward from said strut for engaging with a hook on an adjacent link chain so that when said hooks on said first link chain and said second link chain are coupled together they interlockingly hold said first link chain and said second link chain in a rigid relationship to one another to thereby form a support column.

14. The retractable column of claim 13 including a lift mechanism to lift said link chains upward to couple said hooks on said first link chain to said hooks on said second link chain.

15. The retractable column of claim 13 including at least three link chains each having hooks extending laterally outward from said link chains to permit said link chains to form interlocking engagement with said hooks on adjacent link chains.

16. The retractable column of claim 14 wherein at least some of said hooks extend laterally outward at an angle of approximately 30 degrees with respect to a vertical plane extending through said strut holding said hooks.

17. The retractable column of claim 14 wherein said first link chain includes a link brace with a gear rack connected to said link brace.

18. The retractable column of claim 17 including a gear drive mechanism for engaging said gear rack to thereby raise and lower said first link chain.

19. The retractable column of claim 17 wherein said second link chain includes a link brace with a gear rack connected thereto for engagement with said drive mechanism to permit an operator to simultaneously raise and lower said first link chain and said second link chain.

20. A retractable column for raising, lowering and supporting an overhead structure comprising:

a first link chain having a plurality of pivotable links with lateral coupling means on said first link chain for engaging lateral coupling means on a second link chain and further means for engaging a drive mechanism;

a second link chain having a plurality of pivotable links with lateral coupling means on said second link chain for engaging a lateral coupling means on a third link chain and further means on said second link chain for engaging a drive mechanism;and a third link chain having a plurality of pivotable links with lateral coupling means on said third chain for engaging said lateral coupling means on said first link chain to thereby form a triangular support column that can be raised or lowered through said drive mechanism.

21. The retractable column of claim 20 including alignment pins on said link chains to permit alignment of said link chains with itself as said link chain is stored on a take up mechanism.

22. The retractable column of claim 20 including a link brace gear rack on said first link chain with said link brace gear rack having gear teeth on one side and a channel recess on the opposite side to permit the gear teeth on an adjacent stacked to form a nesting stacked relationship with an adjacent link chain.

23. The method of erecting a support column comprising the steps of:

connecting together the lateral side hooks on three links of three separate link chains to form a triangular structure;

lifting a link vertically upward in at least one of said separate link chains to thereby rotate adjacent links on said separate link chains into coupling engagement with one another;and continuing to lift links on one of said link chains vertically upward until said link chains form a support column.

* * * * *